US005195209A

United States Patent [19]

Watkins

[11] Patent Number: 5,195,209

[45] Date of Patent: Mar. 23, 1993

[54] GUTTER CLEANING SYSTEM

[76] Inventor: Richard L. Watkins, 13250 W. Watson Rd., St. Louis, Mo. 63127

[21] Appl. No.: 745,534

[22] Filed: Aug. 15, 1991

[51] Int. Cl.[5] ..... A47L 9/02

[52] U.S. Cl. ..... 15/339; 15/327.5; 15/347; 15/415

[58] Field of Search ..... 15/327.5, 339, 406; 239/572

[56] References Cited

U.S. PATENT DOCUMENTS

| | | | |
|---|---|---|---|
| 2,456,639 | 12/1948 | Lanter | 15/327.1 X |
| 2,623,234 | 12/1952 | Brown | 15/327.1 X |
| 3,286,446 | 11/1966 | Happe et al. | 15/327.5 X |
| 3,971,098 | 7/1976 | Davis | 15/402 X |
| 4,319,851 | 3/1982 | Arthur | 15/160 X |
| 4,325,162 | 4/1982 | Chambers et al. | 15/327.5 |
| 4,363,335 | 12/1982 | Tapper | 15/406 X |
| 4,402,106 | 9/1983 | Mattson | 15/406 |
| 5,052,073 | 10/1991 | Iida | 15/327.5 |
| 5,056,187 | 10/1991 | Higgins | 15/339 |

*Primary Examiner*—Chris K. Moore

*Attorney, Agent, or Firm*—Norman L. Wilson, Jr.

[57] ABSTRACT

The invention constitutes a gutter cleaning system which includes a canister type vacuum cleaner with tubular wand sections with a nozzle adapted to be inserted into a gutter to remove debris therein. The nozzle carries an optical viewing system such as a fiber optic device or a television camera enabling the operator to observe the cleaning operation as it is performed.

2 Claims, 2 Drawing Sheets

GUTTER CLEANING SYSTEM

BACKGROUND OF THE INVENTION

This invention in one of its aspects pertains to the cleaning of gutters affixed to overhead structures and difficult to clean without a ladder. In another of its aspects the invention is concerned with a gutter cleaning apparatus. In still another aspect the invention relates to a gutter and roof valley cleaning system which enables the operator to monitor the cleaning operation as it proceeds.

Gutter cleaning devices or systems are not new, but rather they seem to have been developed in the 1970s. In U.S. Pat. No. 4,121,320, for instance there is described an apparatus for cleaning gutters with forced air. The apparatus includes a head portion having an opening whose width about the same as the width of the gutter, a hollow support arm, and means for applying forced air to the head portion. U.S. Pat. No. 5,022,586 discloses a gutter cleaning device provided with a nozzle, and an elbow unit riding in the gutter on a wheel member. Water from a garden hose is used to flush out the gutter. Whereas these two patents present solutions to the gutter cleaning problem, they are not without their drawbacks. The washing of gutters with water cannot be accomplished without the operator getting wet and murky. In addition the house itself becomes soiled and stained with debris from the gutter. Frequently the siding and windows have to be washed and the ground cleaned following the gutter cleaning. There is also the possibility of getting water under the shingles and into the attic. A vacuum system for cleaning gutters is the subject of U.S. Pat. No. 3,971,098. In this apparatus a U-shaped manifold is pivotable secured to a yoke member by which it is manipulated. The free end of the manifold can then be maneuvered in the gutter. Attached to the end of the manifold away from the gutter is a flexible vacuum hose. The hose in turn is connected to a conventional canister type wet/dry vacuum system.

The gutter cleaning apparatus of U.S. Pat. No. 3,971,098 solves the gutter cleaning problem, but it nevertheless is subject to improvement. This system, and all of the other gutter cleaning systems referred to are subject to one disadvantage. They have not been completely successful because an operator on the ground cannot see what he is doing. He is unable to observe the cleaning process as it progresses. In older gutters where gutter support straps or rods are weak they can be loosened, bent, or broken by the moving vacuum head. In addition it is not possible to retrieve all of the debris without seeing it.

The wet/dry vacuum system itself is also subject to improvement. The dust and broken leaves accumulate on the filter, making it necessary more frequently than desired to halt the cleaning operation to clear the filter. The electric supply line is also a matter of concern. Not only is the wire running around the house from an outlet, but most standard vacuum cleaners are too heavy. In accordance with the practice of this invention all of these problems have been eliminated, the most important, of course, being the vision or seeing problem.

SUMMARY OF THE INVENTION

Herein a gutter cleaning apparatus is provided enabling the operator to see the cleaning operation as it proceeds. The gutter and roof valley cleaning system of the invention includes: (a) a canister type vacuum cleaner having a hose with one end removably connected to the canister for drawing debris therein, a rigid tubular hose extension removably connected to the hose at its other end enabling an operator to reach the gutter from the ground level, and a nozzle for said tubular extension with one end fitting on the tublular extension and its other end adapated to be inserted into the gutter to contact debris therein; in combination with a visual augmentation system in the form of (b) optical means conveying to the operator an image of the gutter or roof valley adjacent the nozzle end within the gutter or roof valley.

DETAILED DESCRIPTION OF THE INVENTION

As indicated hereinbefore the most important aspect of this invention is the provision of viewing means, along with the other improvements to existing gutter cleaning systems. These improvements can perhaps, best be understood from a description of the invention in conjunction with the accompanying drawings.

Figure 1:
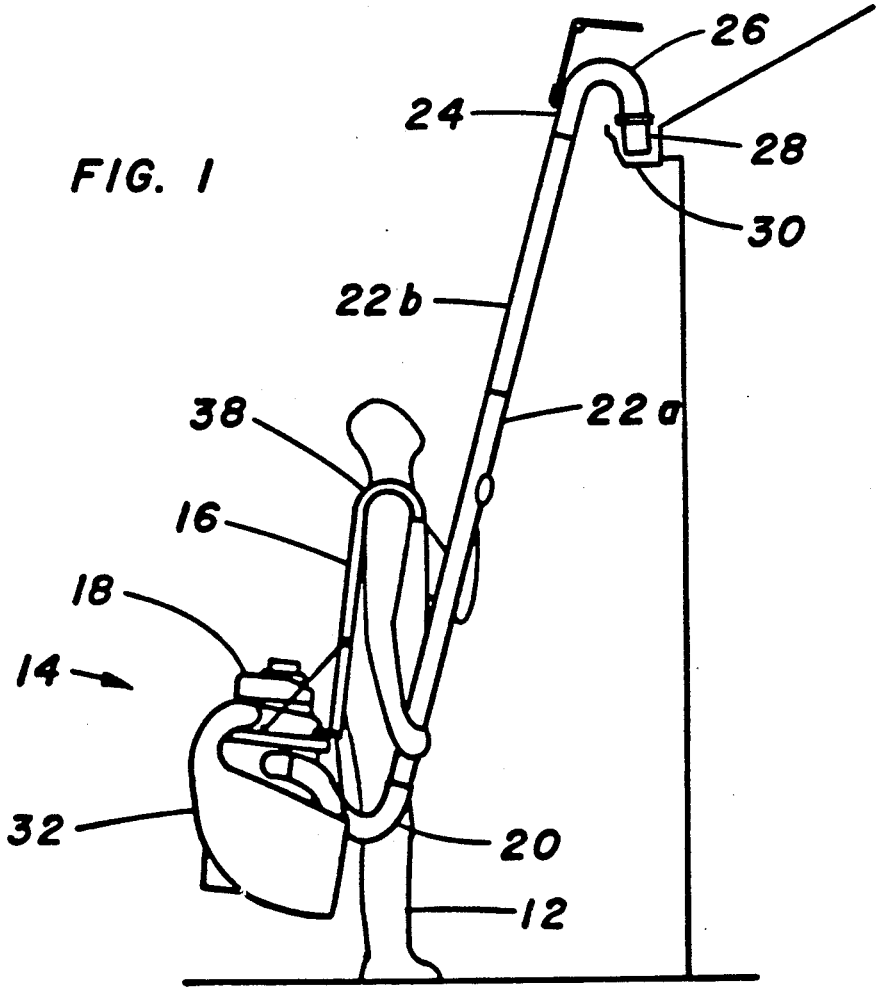
FIG. 1 is a side elevational view of the apparatus of the invention showing it as it is used.

The gutter and roof valley cleaning apparatus of this invention is shown generally in FIG. 1. An operator 12 is shown standing with the cleaning apparatus 14 hanging on his back by harness 16 in the form of hooks 18 resting on the operator's shoulders. The vacuum cleaner per se is of the canister type, however for meneuverability the electric cord is dispensed with. The vacuum impeller is powered by a gasoline engine 18. Connected to the vacuum cleaner is a flexible hose 20 which in turn accepts the desired number of rigid tubular sections **22*a* and 22*b*, the number depending upon the height of the gutter. Specifically, variable length sections of three inch pipe are added to reach the gutter, and as in the prior art, the end of the last tubular section 24 is hooked at 26 and adapted with a tip 28 to fit inside the gutter 30. Since such means are well known, they need not be discussed at length herein. Rather, bag 32** deserves attention.

Figure 2:
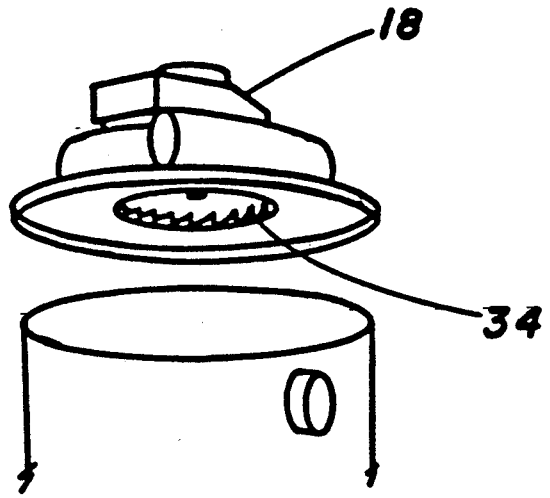
FIG. 2 is a perspective view of the underside of the vacuum apparatus showing the impeller.
Figure 3:
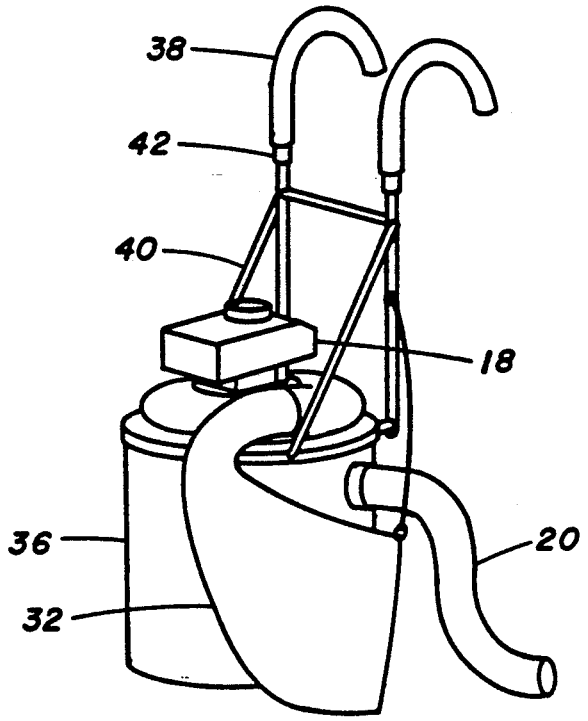
FIG. 3 is a perspective view of the vacuum apparatus of the invention.

Referring now to FIG. 2, it is evident that the vacuum apparatus of the invention, while being the canister type, does not have a filter. Instead the impeller 34 is exposed. As can be seen in FIG. 3, the vacumm apparatus provided herein has both a canister 36 and a bag 32. This has the advantage that there is no filter to clean. Attached to the impeller outlet, or air exhaust duct 38, is the collecting bag 32. During operation wet debris falls into and is collected in the canister. Dry dirt, leaves, and the like pass through the impeller to the impeller outlet and are collected in bag 32, with the air passing therethrough as it does in lawn mowers. A vacuum apparatus is thus provided by this aspect of the invention which does not require frequent stoppages for removing debris from the filter. It is indeed a true wet/dry vacuum system which does not call for filter cleaning. And its use is preferred in the system of this invention.

To effectively use the vacuum apparatus, since there is no electrical cord, the apparatus should be carried. It has been found that the standard shoulder strap is too difficult to get on and off. Accordingly brace members 38 hook over the operator's shoulders with the vacuum apparatus being supported on the operator's back by cross bars 40 as also shown in FIG. 3. They are adapted with swivel joints 42 so that they swing away from the center line between them as shown in FIG. 3. They can then be readily put on and taken off.

In use, with the vacuum operating, the nozzle is moved along the gutter in the well known maner to withdraw the debris. However it will be appreciated that this task cannot be effectively accomplished without the operator being able to see what he is doing. Hence an important feature of the invention is the provision of optical means presenting a full field of view of the gutter for the operator. In other words one of the more constructive features of this invention is the inclusion of an optical assembly enabling the operator to see what he is doing. Three such optical assemblies are shown in the drawings.

Figure 4:
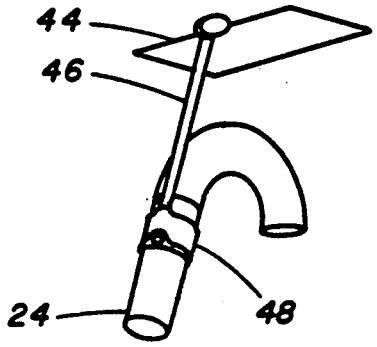
FIG. 4 is a perspective view, partially cutaway, showing a mirror optical means utilized with the invention.

The mirror assembly shown in FIG. 4, is, of course, the cheapest. In this aspect of the invention the mirror 44 is mounted on a pole 46, and by clamps 48 or other means is attached to the last tubular member 24 of the hose members. The operator standing on the ground can then observe the cleaning opertion as it takes place.

Figure 5:
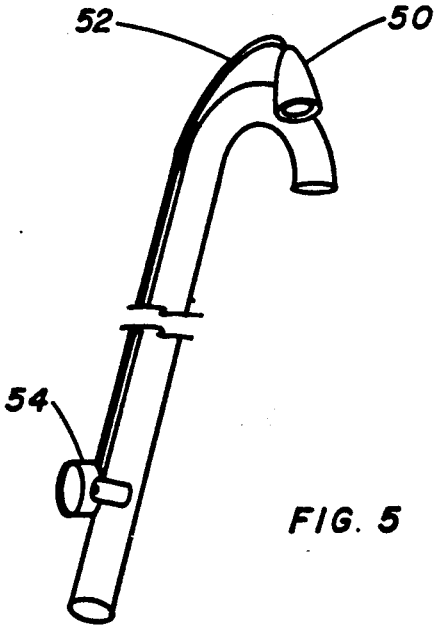
FIG. 5 is a similar view of a fiber optic viewing system employed herein.

Another optical assembly is shown in FIG. 5. This aspect of the invention includes a fiber optic image reception lens unit 50 mounted near the cleaning nozzle and adapted to produce a suitable image. A flexible fiber optic light guide, a fiber optic bundle 52, transmits the images from the lens unit 50 at the gutter to a magnifying viewer 54. Such lens, fiber optic bundles, and magnifying viewers are known in the art. It is emphasized that an optical fiber system such as that described requires no power. As long as there is sufficient natural light the immage will be transmitted from the lens 50 through the fiber optic light bundle 52 to the viewer 54.

Figure 6:
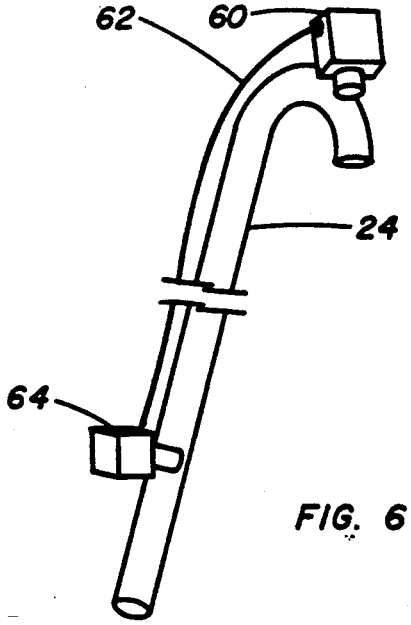
FIG. 6 is also a similar view, now showing a video viewing system as employed herein.

A still different embodiment of the invention is shown in FIG. 6. This system includes a video system. Preferably battery powered, a camera 60 is mounted on the last tubular section 24. This camera, through wire 62, is connected to television monitor 64. By monitoring the cleaning process as it proceeds the operator can effectively clean the gutter.

It can be seen that by the practice of this invention a gutter cleaning system is provided which overcomes all of the disadvantages of those prior art devices. Means enabling the operator to monitor the cleaning operation as it proceeds have not been provided hereinbefore, particularly the fiber optic visualization means. Thus, a gutter cleaning system is provided having greater commercial acceptance than those employed heretofore. Having been given the teachings of this invention variations and ramifications are possible within the spirit of the invention. Thus, changes in the optical systems such as curved mirrors, magnifying lens and holders can be employed. Means can also be utilized for changing the angle or direction of the optical piece attached to tubular section 24 for better viewing. Similarly, various harness devices and means for carrying the vacuum canister apparatus will become obvious. These are given by way of example only, and other changes will occur to those skilled in the art. Such modifications are deemed to be within the scope of this invention.

What is claimed is:

1. In a gutter and roof valley cleaning system, the combination of (a) a canister type vacuum cleaner having a hose with one end removably connected to the canister for drawing debris therein, a rigid tubular hose extension removably connected to the hose at its other end enabling an operator to reach the gutter from the ground level, and a nozzle for said tubular extension with one end fitting on the tubular extension and its other end adapted to be inserted into the gutter to contact debris therein; with (b) optical means conveying to the operator an image of the gutter or roof valley adjacent the nozzle end within the gutter or roof valley, the optical means including a fiber optic lens adjacent the nozzle, and a fiber optic bundle conveying to the operator the image of the area adjacent the nozzle.

2. In a gutter and roof valley cleaning system, the combination of (a) a canister type vacuum cleaner having a hose with one end removably connected to the canister for drawing debris therein, a rigid tubular hose extension removably connected to the hose at its other end enabling an operator to reach the gutter from the ground level, and a nozzle for said tubular extension with one end fitting on the tubular extension and its other end adapted to be inserted into the gutter to contact debris therein; with (b) optical means conveying to the operator an image of the gutter or roof valley adjacent the nozzle end within the gutter or roof valley, the optical means including a television system with a camera portion adjacent the nozzle and a screen enabling the operator to see the image of an area adjacent the nozzle.

* * * * *